United States Patent [19]

Christianson

[11] Patent Number: 4,574,797

[45] Date of Patent: Mar. 11, 1986

[54] DIAPHRAGM AND EXHAUST VALVE FOR SECOND STAGE REGULATOR

[76] Inventor: Tony Christianson, P.O. Box 3700, Manhattan Beach, Calif. 90266

[21] Appl. No.: 492,992

[22] Filed: May 9, 1983

[51] Int. Cl.[4] ..... A62B 7/04

[52] U.S. Cl. ..... 128/204.26; 137/494; 137/908

[58] Field of Search ..... 128/204.26, 204.27, 128/205.24; 137/494, 510, 512.4, 855, DIG. 9

[56] References Cited

U.S. PATENT DOCUMENTS

| | | | |
|---|---|---|---|
| 2,929,376 | 3/1960 | Kemper | 128/204.26 |
| 4,041,978 | 8/1977 | Leeman | 128/204.26 |
| 4,259,951 | 4/1981 | Chernack et al. | 137/512.4 |
| 4,306,584 | 12/1981 | Schlobohm | 128/204.26 |
| 4,411,603 | 10/1983 | Kell | 137/855 |

*Primary Examiner*—Henry J. Recla

*Attorney, Agent, or Firm*—Spensley Horn Jubas & Lubitz

[57] ABSTRACT

A diaphragm and exhaust valve for an underwater breathing apparatus second stage regulator are combined to conserve breathing gas during all orientations of the diver, to provide smooth operation of the diaphragm without interference from exhaust bubbles, and to provide unrestricted exhaust flow. In addition, the diaphragm and exhaust valve are fabricated and installed as a single component.

7 Claims, 5 Drawing Figures

DIAPHRAGM AND EXHAUST VALVE FOR SECOND STAGE REGULATOR

BACKGROUND OF THE INVENTION

1. Field of the Invention

The present invention relates to regulators for underwater breathing apparatus and more particularly to the diaphragm and exhaust valve of second stage regulators.

2. Description of the Prior Art

In a typical underwater breathing apparatus, air or other breathable gas is supplied to a diver from a high pressure tank via a two stage regulating system. The regulator first stage is mounted to the high pressure tank valve and functions to reduce tank gas pressure to about 150 psi above ambient pressure. The tank and regulator first stage are carried by the diver on his back. A flexible hose conduit supplies the reduced pressure gas to a regulator second stage held by the diver's mouth with a mouthpiece. The second stage is a demand regulating device which opens to supply breathing gas at ambient pressure in response to inhalation effort. Provision is also made to exhaust exhaled gas through the mouthpiece into the water.

Inhalation suction pressure is sensed by a diaphragm within the second stage that cooperates with a lever to open a valve which controls the flow of gas to the diver. Whenever the diver stops breathing, or exhales, the diaphragm responds to the lack of inhalation suction by stopping the flow of gas. A separate exhaust valve is provided to permit the escape of exhaled gases. The exhaust valve, due to physical and dimensional constraints, is a component which is separate from the diaphragm and is typically located several inches away from the diaphragm.

The separation of the diaphragm and exhaust valve in the prior art is a shortcoming because whenever the swimming diver is oriented so that the exhaust valve is over (closer to the water surface than) the diaphragm, the exhaust valve is at a slightly lower pressure in the water than the diaphragm, and a sensitive diaphragm will respond to the slight loss of pressure through the exhaust valve by inadvertently turning "on" the regulator which results in an unwanted loss of breathing gas. The larger the separating distance between exhaust valve and diaphragm, the greater the waste of breathing gas. An object of the present invention is to close the spacing between the exhaust valve and diaphragm and thereby prevent the unnecessary waste of breathing gas.

Some configurations of prior art place the exhaust valve at the center of the diaphragm or actually combine the functions of diaphragm and exhaust valve. Such a configuration is disclosed in the inventor's U.S. Pat. No. 4,297,998 issued Nov. 3, 1981 entitled PILOT CONTROLLED REGULATOR SECOND STAGE. In this type of configuration, typically the flow of exhaled gases past the exhaust valve generates numerous bubbles as water is displaced by the expanding gas. These bubbles set up a lingering turbulence which can remain even after exhalation is completed and a new inhalation cycle has been initiated. Such turbulence disrupts the smooth operation of the mutually located, exposed diaphragm. Another object of the present invention is to isolate the closely spaced diaphragm and exhaust valve from each other such that exhaust bubbles do not interfere with the smooth operation of the diaphragm.

Another shortcoming of prior art is that the flow of exhaled gases is restricted by the limited size of the exhaust valve and related passages. Another object of the present invention is to provide an exhaust valve with flow passages which do not restrict the flow of exhaled gases.

Another shortcoming of prior art is that the diaphragm and exhaust valve are separate components which must be individually fabricated and mounted. An object of the present invention is to provide a diaphragm and exhaust valve which are a single component.

SUMMARY OF THE INVENTION

The objective of the present invention is to provide a diaphragm and exhaust valve system which conserves breathing gas during all orientations of the diver, and in which the diaphragm and exhaust valve are in close proximity to one another.

Another objective of the present invention is to provide a diaphragm and exhaust valve system which enables the diaphragm to function smoothly and without interference from exhaust bubbles.

Another objective of the present invention is to provide an exhaust valve with unrestricted flow passages.

Another objective of the present invention is to provide a diaphragm and exhaust valve which are fabricated and mounted as a single component.

BRIEF DESCRIPTION OF THE DRAWINGS

A detailed description of the invention will be made with reference to the accompanying drawings wherein like numerals designate corresponding parts in the several figures.

DESCRIPTION OF THE PREFERRED EMBODIMENT

The following detailed description is of the best presently contemplated mode of carrying out the invention. This description is not to be taken in a limiting sense, but is made merely for the purpose of illustrating the general principles of the invention since the scope of the invention is best defined by the appended claims.

Figure 1:
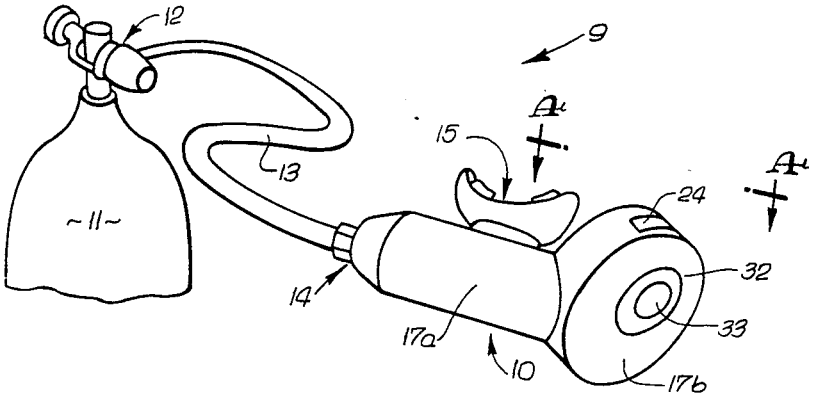
FIG. 1 is a pictorial view of an underwater breathing apparatus having a regulator second stage incorporating the inventive diaphragm and exhaust valve system.

In FIG. 1 there is shown an underwater breathing apparatus 9 incorporating a demand regulator 10 in accordance with the present invention. The apparatus 9 includes a supply tank 11 containing breathable gas under high pressure. Attached to tank 11 is a regulator first stage 12 which provides the breathable gas at a reduced pressure, typically 150 psi above ambient, to a conduit 13. The regulator second stage 10 is connected to the other end of the conduit 13 via an inlet port 14, and functions to deliver breathable gas at ambient pressure to a diver via a mouthpiece outlet port 15 upon inhalation demand.

Figure 2:
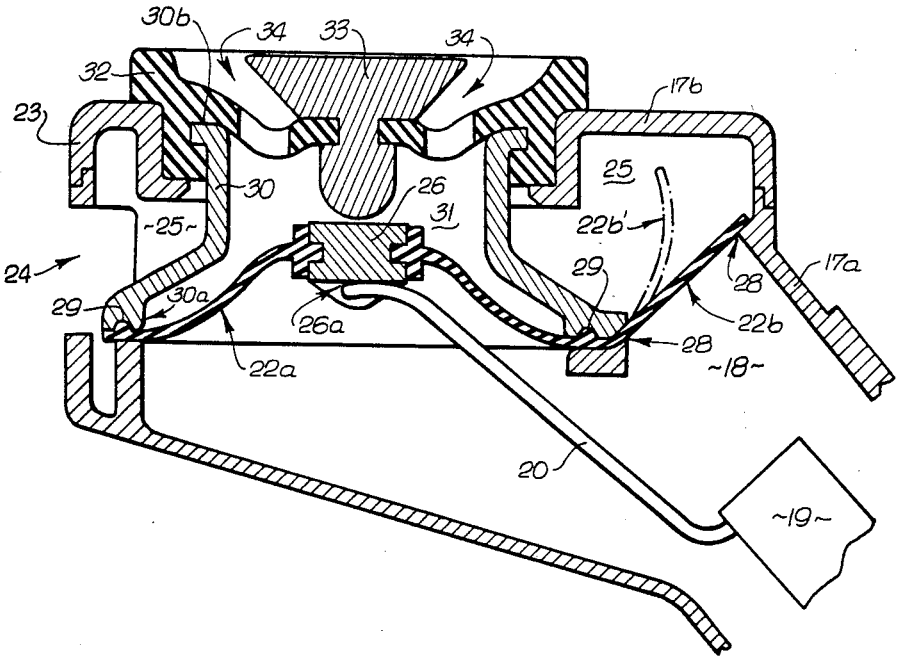
FIG. 2 is a sectional side view of the regulator second stage as seen along the line A—A of FIG. 1, and showing the inventive system with the diaphragm in the neutral or "regulator off" condition and the exhaust valve in the "closed" position. The exhaust valve in the "open" position is represented in the figure by dot-dash phantom lines.
Figure 3:
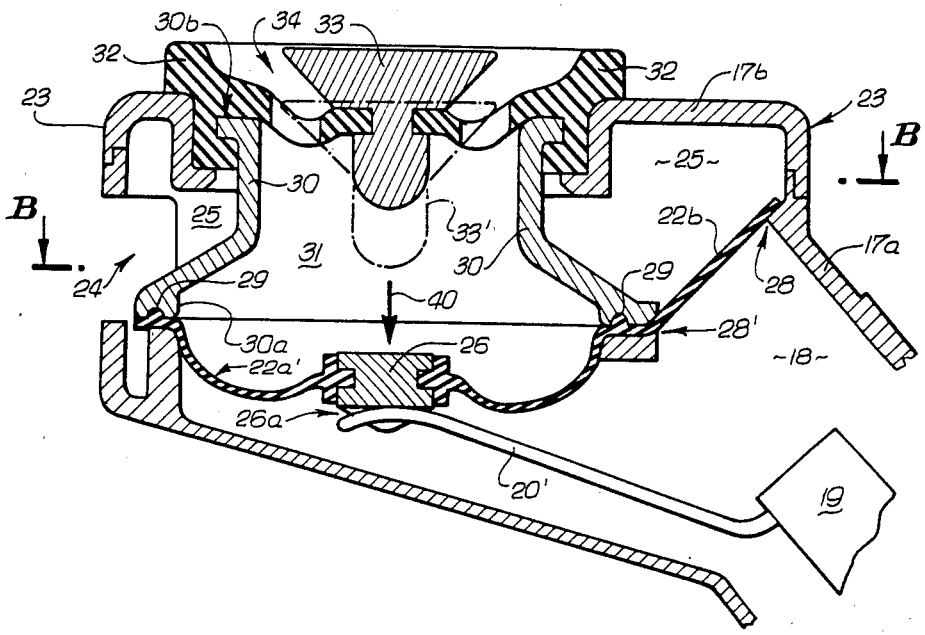
FIG. 3 is the same side view of the inventive system shown in FIG. 2, but with the diaphragm in the depressed or "regulator on" condition. A purge button in the "pushed" condition is represented in the figure by dot-dash phantom lines.

As evident in FIG. 1, the body 17 of the regulator 10 includes a cylindrical section 17*a* that defines an interior chamber 18 (FIGS. 2 and 3). A flow control valve housing 19 is situated within the body section 17*a*. A conventional valve within the housing 19 controls the flow of breathable gas from an inlet port 14 to the mouthpiece outlet port 15.

As evident in FIGS. 1 and 2, rigidly attached to the body section 17*a* is a generally cylindrical housing 17*b* that contains the inventive diaphragm and exhaust valve system. This diaphragm and exhaust valve housing 17*b* includes a cylindrical outer wall 23 having one or more openings 24 that admit water into a chamber 25.

Contained within the outer wall 23 is a separating wall 37 (best described below in connection with FIG. 5) which separates the interior chamber 18 from the chamber 25. Also within the outer wall 23 is a diaphragm chamber wall member 30 which encompasses a chamber 31 that is enclosed at one end 31*a* by the diaphragm 22*a* and at the other end 31*b* by a flexible cover 32. The cover 32 has one or more openings 34 that admit water into the chamber 31.

The diaphragm 22*a* is of generally circular, concave configuration and is made of a resilient, highly flexible rubber or plastic material. The diaphragm 22*a* is firmly clamped in place along a peripheral bead 22*c* which mates with the wall member 30. At the center of the diaphragm 22*a* is a rigid cylindrical plug 26 which makes sliding contact (at 26*a*) with an arm 20. The arm 20 links the diaphragm 22*a* with the flow control valve within the housing 19.

The diaphragm 22*a* is shown in FIG. 2 in the neutral or relaxed position. The arm 20 is thereby also in its neutral position with the result that the flow valve within the housing 19 is closed. Such a neutral position of the diaphragm 22*a* is attained when the pressures of the interior chamber 18 and the exterior chamber 31 are equal.

During inhalation, the pressure in the chamber 18 is reduced, causing the diaphragm 22*a* to move in the direction of the arrow 40 (FIG. 3). As a result, the diaphragm 22*a* is displaced to an intermediate position 22*a*′ and the lever 20 is correspondingly moved to a position 20′. Movement of the lever 20 to the position 20′ causes the flow valve within the housing 19 to open, thereby flowing breathing gas into the chamber 18 and subsequently through the mouthpiece outlet port 15. When inhalation is stopped, the pressures of the chambers 31 and 18 on both sides of the diaphragm 22*a* are once again equal. The natural resilience of the diaphragm 22*a* returns it to its neutral position, with a corresponding return of the lever 20 to its neutral position. In this manner breathable gas is supplied to the diver only on inhalation demand.

The cover 32 is generally circular and is made of a resilient rubber or plastic material. An interlocking arrangement between a peripheral flange 30*b* at the end of a cylindrical portion of the wall member 30 and a cap member 36 firmly holds the cover 32 in place.

Mounted in the center of the cover 32 is a generally conical, rigid purge button 33. Manually pushing the button 33 inward flexes the cover 32 so that the button 33 is moved to an intermediate position 33′ shown in phantom in FIG. 3. Such an inward movement of the purge button 33 will cause a corresponding displacement of the diaphragm 22*a* and the lower 20, thereby opening the flow valve within housing 19. The resultant flow of breathing gas purges the regulator 10.

Figure 4:
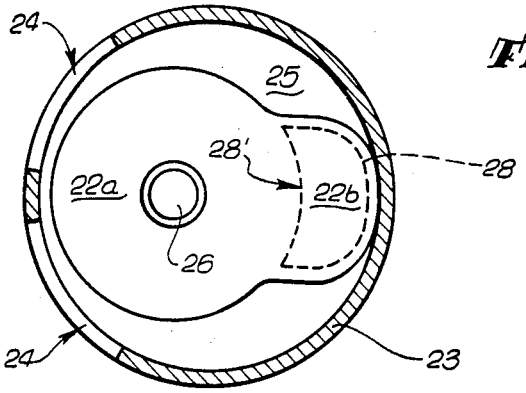
FIG. 4 is a sectional top view of the inventive device as viewed in the direction B—B of FIG. 3. The exhaust opening, which is covered by the exhaust valve, is shown in the figure by a dash line.

The exhaust valve flap 22*b* is of generally flat semicircular shape and is made of a resilient, highly flexible rubber or plastic material. The exhaust valve flap 22*b* closes the passage formed between the chambers 18 and 25 by sealing along an edge 28 of the separating wall 37. As shown in FIG. 4, the exhaust valve flap 22*b* and the diaphragm 22*a* are formed as a single component. The diaphragm chamber wall member 30 clamps the diaphragm 22*a* in place, and thereby also locates and clamps in place the exhaust valve flap 22*b* such that they are physically side-by-side. The resultant close proximity between the exhaust valve and the diaphragm assures that slight pressure losses through the exhaust valve will not be sufficient to displace the diaphragm inward with a subsequent release of breathing gas.

During exhalation, the pressure in the chamber 18 exceeds that in the chamber 25. As a result, the exhaled gases cause the exhaust valve flap 22*b* to deflect outward, as to the position 22*b* shown in phantom in FIG. 2. The relatively large opening bounded by the edge 28 and 28′ enables unrestricted flow of the exhaled gases into the relatively large volume of the chamber 25 and subsequently out of the regulator 10 via the openings 24.

The wall member 30 isolates the chambers 25 and 31, and thereby isolates the diaphragm 22*a* from the turbulance generated by the exhaled gases as they flow through the chamber 25. As a result, operation of the diaphragm 22*a* is not affected by the flow of gas from the exhaust valve.

Figure 5:
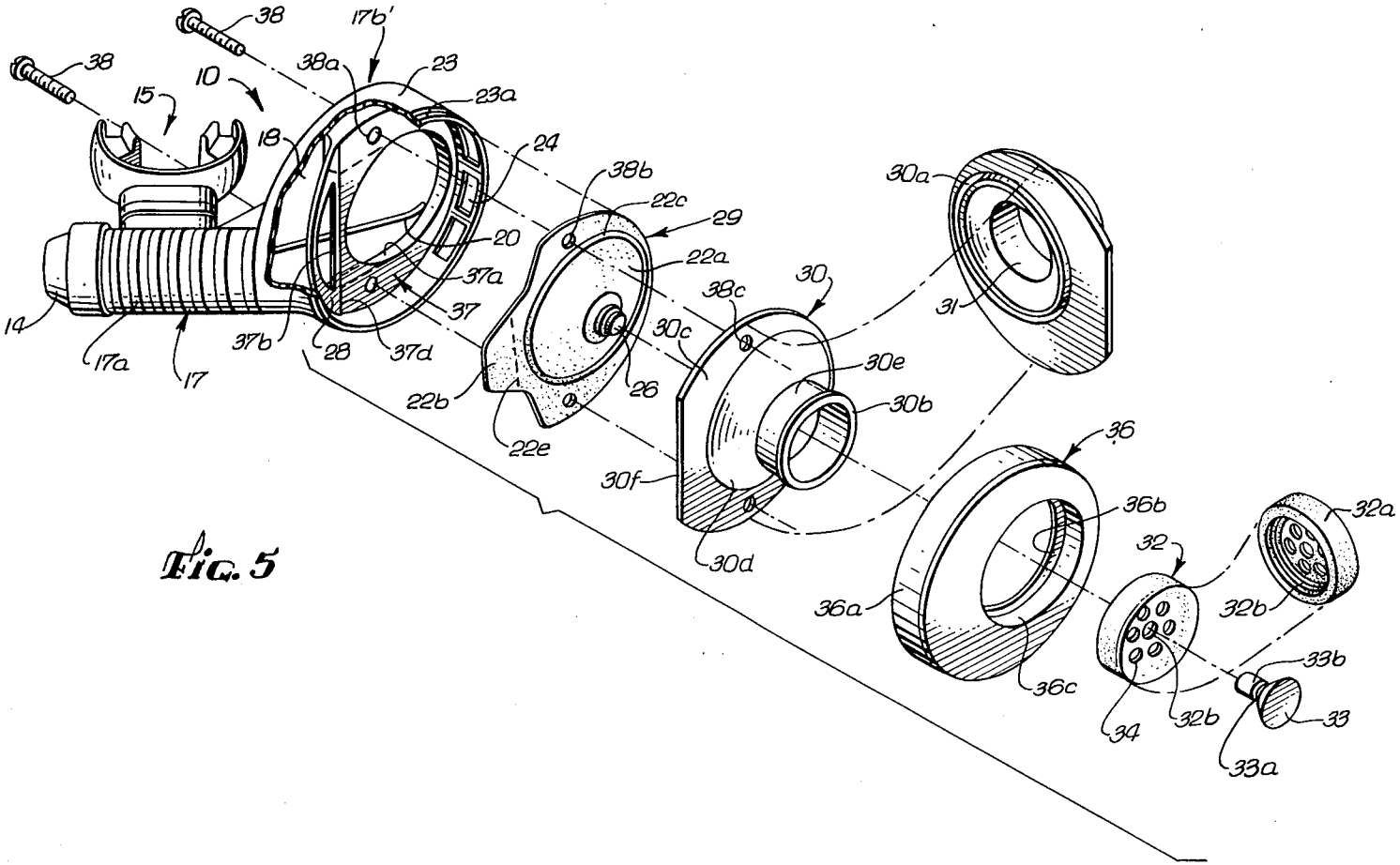
FIG. 5 is an exploded perspective view of the regulator second stage incorporating the present invention.

The exploded view of FIG. 5 shows a preferred embodiment of the invention which is configured for ease of manufacture and assembly. The main portion 17 of the housing is a unitary molding that includes the cylindrical section 17*a* and a portion 17*b*′ of the cylindrical housing that contains the inventive diaphragm and exhaust valve assembly. This cylindrical housing is completed by a rigid cap member 36, the cylindrical skirt 36*a* of which has an interior peripheral ledge that matingly engages a corresponding recess 23*a* on the cylindrical housing 17*b*′.

The separating wall 37 is situated within the cylindrical housing 17*b*′, and divides the interior of the housing 17 into an interior chamber 18 and an exterior zone encompassing the chambers 25 and 31. The separating wall 37 has two closely adjacent spaced openings therewithin. The first is a circular opening 37*a* which is covered by the inhalation sensing diaphragm 22*a*. The second is a generally semicircular exhaust opening 37*b* which is overlaid by the exhaust valve flap 22*b*. Advantageously, the portion 28 of the separating wall 37 which surrounds the semicircular portion of the opening 37*b* is disposed at an angle with respect to the plane of the portion of the separating wall 37 surrounding the circular opening 37*a*.

A unitary diaphragm member 29, including the diaphragm 22*a* and the exhaust valve flap 22*b*, seats against the separating wall 37. The member 30 is held in place by a pair of screws 38 which pass through holes in the housing 17, holes 38*a* in the separating wall 37, holes 38*b* in the unitary diaphragm member 29, and threaded holes 38*c* in the diaphragm chamber wall member 30. A circular groove 30*a* captures the circular bead 22*c* surrounding the diaphragm 22*a*, thereby preventing slippage of the unitary diaphragm member 29 parallel to the surface of the separating wall 37.

The wall member 30 includes a conical portion 30*d* which is truncated by and communicates with a cylindrical section 30*e*. The conical portion 30*d* is dimensioned to provide room for unimpeded movement of the inhalation sensing diaphragm 22*a*. The interior of the conical portion 30*d* and the cylindrical portion 30*e* form the chamber 31 which communicates to the exterior of the second stage 10 via the holes 34 in the cover 32. Thus one side of the inhalation sensing diaphragm 22*a* is exposed to the inhalation pressure within the interior chamber 18, while the other side of the diaphragm 22*a* is exposed to ambient conditions, (e.g., the ambient water pressure).

The diaphragm chamber wall member 30 also defines the inner wall of the chamber 25 which communicates to the exterior of the regulator 10 via the openings 24. It is through this chamber 25 that exhaled gases are exhausted.

The planar peripheral portion 30*c* of the wall member 30 is truncated along a straight edge 30*f* which captures the proximal edge 22*e* of the exhaust valve flap 22*b* which lies along the bend line 37*d* of the separating wall 37. This arrangement permits the exhaust valve flap 22*b* to deflect away from the semicircular opening 37*b* (as shown in FIG. 2) to create an exhaust path for exhaled gases.

The use of the diaphragm chamber wall member 30 eliminates detrimental interaction between the flow of exhaled gases and the inhalation sensing diaphragm 22*a*. By utilizing separate chambers 25 and 31, the exhaled gases flow past the exhaust valve flap 22*b*, through the chamber 25 and the openings 24 to the exterior of the regulator 10, without adverse affect on the inhalation sensing diaphragm 22*a* which is separated from the exhaled gases by the wall member 30. Accordingly, an arrangement is achieved in which the exhaust valve is situated in close proximity to the inhalation sensing diaphragm, and yet is isolated therefrom.

For ease of assembly, the cap member 36 is held in place by the flexible cover 32, the cylindrical skirt 32*a* of which overlies the cylindrical portion 30*e* of the wall member 30. A peripheral flange at the end 30*b* of the wall member 30 is engaged by a corresponding groove 32*b* in the interior of the skirt 32*a*.

The cylindrical portion 30*e* of the wall member 30 projects through an opening 36*c* in the cap member 36. This opening 36*c* has a diameter just slightly larger than that of the skirt 32*a* so that the flexible cover 32 will be situated within the opening 36*c* when the skirt 32*a* is in engagement with the wall member end flange 30*b*. A flange 36*b* in the opening 36*c* engages the bottom of the skirt 32*a*, so that the cover 32 prevents separation of the cap member 36 from the housing 17.

The purge button 33 has a groove 33*a* that engages the central opening 32*b* in the flexible cover 32. When the purge button 33 is depressed, a projection 33*b* engages the plug 26 at the center of the diaphragm 22*a* and presses this plug against the lever 20, thereby opening the air inlet valve to purge the regulator.

I claim:

1. In a second stage regulator for a self-contained underwater breathing apparatus of the type including a housing having an inlet adapted to be connected to a source of gas and a mouthpiece outlet adapted to be connected to a mouthpiece, and valve means mounted in said housing valve for controlling the flow of breathable gas from said inlet to said mouthpiece outlet, the improvement comprising:

a wall mounted in and separating the interior of said housing into an interior chamber containing said valve means and communicating to said mouthpiece outlet and a region communicating to the exterior of said regulator, said wall having two adjacent, closely spaced openings therewithin;

a unitary diaphragm member adapted to overlay said separating wall, said diaphragm member having:

a generally conical diaphragm section overlying a first of said spaced openings, and an exhaust valve flap portion overlying the second of said openings and being flexible away from said interior chamber to uncover said second opening, thereby to permit the exhaust of exhaled gases from said interior chamber via said region to the exterior of said regulator, linkage means connected between said valve means and said diaphragm section whereby a decrease in pressure in said interior chamber caused by inhalation moves said diaphragm section and linkage means and actuates said valve in response thereto, a rigid, generally convex diaphragm wall member situated within said region and having a first divergent end portion mounted to clamp said unitary diaphragm member to said separating wall about the periphery of said conical diaphragm section and an opposite convergent end portion, said convex wall member permitting movement of said diaphragm in response to inhalation pressure, and an outer wall member connected between said convex wall member adjacent the convergent end portion thereof and said housing, said convex wall member and said outer wall member separating said region into two chambers, each wall member having openings communicating each chamber separately to the exterior of said regulator, exhaust gases flowing through one of said chambers, said diaphragm being exposed to the external ambient environment via the other of said chambers.

2. The improvement of claim 1 wherein said rigid diaphragm wall member clamps only an edge of said exhaust valve flap portion to said separating wall.

3. The improvement of claim 1 wherein said separating wall, said unitary diaphragm member and said diaphragm wall member are secured in place by fasteners extending through said housing, said separating wall, said diaphragm member and said wall member.

4. The improvement of claim 1 wherein the divergent end portion of said diaphragm wall member includes a truncated generally conical portion in spaced covering relationship with said diaphragm and a cylindrical portion extending from said truncated convergent end portion of said conical portion, and a resilient cover resiliently engaging the end of said cylindrical portion, there being openings in said cover for communication to the exterior of said regulator.

5. The improvement of claim 4 wherein said outer wall member comprises:

a removable rigid cap member having an opening through which at least the end of said diaphragm wall member cylindrical portion projects, said resilient cover blocking the removal of said cap member from said regulator when said cover is in engagement with said projecting end of said diaphragm wall member cylindrical portion.

6. In a demand regulator for a self-contained underwater breathing apparatus having a mouthpiece and including a housing having an inlet adapted to be connected to a source of gas and a mouthpiece outlet adapted to be connected to said mouthpiece, and valve means mounted in said housing valve for controlling the flow of breathable gas from said inlet to said mouthpiece outlet, the improvement comprising:

a double apertured wall within said housing which separates the interior of said regulator into two regions, one region communicating with the regulator moutpiece outlet;

a combined diaphragm and exhaust valve flap member adapted to overlie said double aperture wall, the diaphragm section of said combined member overlying one of said apertures and being adapted to sense a change in pressure in said one region communicating with said regulator mouthpiece and means cooperatively connected with said diaphragm section for controlling said valve means in response to said sensed change in pressure, and a hollow rigid chamber defining member having an end defining a peripheral surface complementally shaped to the peripheral surface surrounding said one aperture over which said diaphragm section lies and wherein said rigid chamber defining member clamps the periphery of said diaphragm section to the portion of said wall surrounding said one aperture, the exhaust valve flap member extending exteriorly of said clamping end and overlying the other of said apertures, said chamber defining member having a wall portion separating the other of said regions into two chambers, one chamber covering said diaphragm section, the other chamber covering said exhaust flap valve member and each separately communicating with the exterior of said regulator.

7. The improvement of claim 6 wherein said chamber defining member includes a truncated conical portion which overlies said diaphragm section, said end being planar and having a portion which projects radially outwardly from one end of said conical portion and which clamps the periphery of said diaphragm section, said planar end having a longitudinal edge which clamps the proximal portion of said exhaust valve flap.

* * * * *